US009163189B2

(12) United States Patent
Russo et al.

(10) Patent No.: US 9,163,189 B2
(45) Date of Patent: Oct. 20, 2015

(54) BALANCED UNLEADED FUEL COMPOSITIONS

(71) Applicant: SHELL OIL COMPANY, Houston, TX (US)

(72) Inventors: Joseph Michael Russo, Katy, TX (US); Timothy Michael Shea, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 573 days.

(21) Appl. No.: 13/690,774

(22) Filed: Nov. 30, 2012

(65) Prior Publication Data

US 2013/0139431 A1 Jun. 6, 2013

Related U.S. Application Data

(60) Provisional application No. 61/565,570, filed on Dec. 1, 2011.

(51) Int. Cl.

| | |
|---|---|
| ***C10L 1/182*** | (2006.01) |
| ***C10L 1/06*** | (2006.01) |
| ***C10L 1/16*** | (2006.01) |
| ***C10L 10/08*** | (2006.01) |

(52) U.S. Cl.

CPC ..... *C10L 1/1824* (2013.01); *C10L 1/06* (2013.01); *C10L 1/1616* (2013.01); *C10L 10/08* (2013.01); *C10L 2230/22* (2013.01); *C10L 2270/023* (2013.01)

(58) Field of Classification Search

USPC ..... 44/451

See application file for complete search history.

(56) References Cited

U.S. PATENT DOCUMENTS

| | | | |
|---|---|---|---|
| 4,247,726 | A | 1/1981 | Slaugh |
| 4,812,146 | A | 3/1989 | Jessup |
| 5,015,356 | A | 5/1991 | Talbert |
| 5,284,984 | A | 2/1994 | Dessau et al. |
| 5,312,542 | A | 5/1994 | Talbert |
| 5,470,358 | A | 11/1995 | Gaughan |
| 6,030,521 | A | 2/2000 | Jessup et al. |
| 6,353,143 | B1 | 3/2002 | Fang et al. |
| 6,383,236 | B1 | 5/2002 | Welstand et al. |
| 8,628,594 | B1 | 1/2014 | Braly |
| 2002/0045785 | A1 | 4/2002 | Bazzani et al. |
| 2002/0143216 | A1 | 10/2002 | Tsurutani et al. |
| 2003/0046862 | A1 | 3/2003 | Wolf et al. |
| 2003/0145514 | A1 | 8/2003 | Akimoto et al. |
| 2003/0183554 | A1 | 10/2003 | Bazzani et al. |
| 2004/0124122 | A1 | 7/2004 | Clark |
| 2006/0102145 | A1 | 5/2006 | Cohn et al. |
| 2006/0123696 | A1 | 6/2006 | Gaughan et al. |
| 2008/0134571 | A1 | 6/2008 | Landschof et al. |
| 2009/0277078 | A1 | 11/2009 | Schweiger et al. |
| 2010/0018112 | A1 | 1/2010 | Russo et al. |
| 2012/0080000 | A1 | 4/2012 | Landschof et al. |
| 2012/0279113 | A1 | 11/2012 | Landschof et al. |

FOREIGN PATENT DOCUMENTS

| | | |
|---|---|---|
| AU | 2006351908 | 6/2011 |
| CA | 2672211 | 6/2014 |
| EP | 1359207 | 11/2003 |
| EP | 1650287 | 4/2006 |
| EP | 1650289 | 4/2006 |
| EP | 2031043 | 7/2010 |
| GB | 2433265 | 6/2007 |
| WO | 0073403 | 12/2000 |
| WO | WO 00/73403 A1 | 12/2000 |
| WO | 0222766 | 3/2002 |
| WO | WO 02/22766 A1 | 3/2002 |

OTHER PUBLICATIONS

HSE (Health & Safety Executive) Occupational Medicine and Hygiene Laboratory, "Aromatic Amines in Air and on Surfaces," MDHS 75 (Methods for the Determination of Hazardous Substances), Feb. 1993, pp. 1-4.

J. Gary, et al., "Petroleum Refining," Technology and Economics (2d Ed. 1984) Chapter 10, pp. 159-183.

Kirk-Othmer., Concise Encyclopedia of Chemical Technology ($4^{th}$ Ed. 1999) vol. 1, pp. 75-76.

Anonymous, "Units with special names and symbols: units that incorporate special names and symbols," Internet Citation Oct. 16, 2007, XP007914325, Retrieved from the Internet: URL:http://web.archive.org/web/20071016181335/http://www.bipm.org/en/si/si_brochure/chapter2/2-2/2-2-2.html [retrieved on May 1, 2014].

Ghosh, P., et al., "Development of a Detailed Gasoline Composition-Based Octane Model," Ind. Eng. Chem. Res. 2006, vol. 45, pp. 337-345.

Tolga Topgül et al., "The effects of ethanol-unleaded gasoline blends and ignition timing on engine performance and exhaust emissions," Renewable Energy, vol. 31, (2006), pp. 2534-2542, XP025105627.

Werner Dabelstein et al., "Automotive Fuels," Internet Citation, Jan. 1, 2007, pp. 1-36, XP007910433.

Spruson & Ferguson. "Examination Response/Withdrawal of Postponement of Acceptance," Feb. 14, 2011. Australian Patent Application No. 2006351908. [8 pages].

State Actions Banning MTBE (Statewide) EPA420-B-04-009, Jun. 2004.

HSE (Health & Safety Executive) Occupational Medicine and Hygiene Laboratory; "Aromatic Amines in Air and on Surfaces," MDHS 75 (Methods for the Determination of Hazardous Substances), Feb. 1993, pp. 1-4.

(Continued)

*Primary Examiner* — Rebecca M Fritchman
*Assistant Examiner* — Chantel Graham

(57) ABSTRACT

Balanced unleaded fuel compositions exhibiting: a pump octane rating of greater than 93; a T50 (maximum) of 104.4° C. (220° F.) and a T90 (maximum) of 165.6° C. (330° F.), as required under the CARB Phase 3 model; and, producing a higher average torque and/or higher average power output than commercially available fuels stated to meet the CARB Phase 3 model.

26 Claims, No Drawings

(56) References Cited

OTHER PUBLICATIONS

Gary, J. et al.; "Petroleum Refining," Technology and Economics (2d Ed. 1984) Chapter 10, pp. 159-183.

Kirk-Othmer.; Concise Encyclopedia of Chemical Technology (4th Ed. 1999) vol. 1, pp. 75-76.

Topgül, Tolga, et al.; "The effects of ethanol-unleaded gasoline blends and ignition timing on engine performance and exhaust emissions," Renewable Energy, vol. 31, (2006), pp. 2534-2542, XP025105627.

Anonymous; "Units with special names and symbols: units that incorporate special names and symbols," Internet Citation Oct. 16, 2007, XP007914325, Retrieved from the Internet: URL:http://web.archive.org/web/20071016181335/http://www.bipm.org/en/si/si_brochure/chapter2/2-2/2-2-2.html [retrieved on Aug. 6, 2010].

Dabelstein, Werner et al.; "Automotive Fuels," Internet Citation, Jan. 1, 2007, pp. 1-36, XP007910433.

BALANCED UNLEADED FUEL COMPOSITIONS

The present application claims the benefit of pending U.S. Provisional Patent Application Ser. No. 61/565,570, filed Dec. 1, 2011, the entire disclosure of which is hereby incorporated by reference.

FIELD OF THE INVENTION

The present application provides balanced unleaded fuel compositions that that meet the California Air Resources Board ("CARB") Phase 3 model.

BACKGROUND OF THE INVENTION

It is advantageous for unleaded fuel compositions to meet the CARB Phase 3 model. 13 CCR §§2657-2273 (last updated January, 2010) esp. 13 CCR §2265. Among other things, the CARB Phase 3 model specifies a temperature at which 50 vol. % of the unleaded fuel composition vaporizes, a "T50 (maximum)", of 104.4° C. (220° F.), and a temperature at which 90 vol. % of the unleaded fuel composition vaporizes, a "T90 (maximum)" of 165.6° C. (330° F.) (both measured using ASTM D-86-10a (1999)).

It is also advantageous for the pump octane rating of the fuel to be high enough to prevent knocking. Gasolines sold at service stations typically have a pump octane rating of from about 87 to about 93. Fuels exhibiting such pump octane numbers are satisfactory for most automotive engines. For high performance engines, and for racing engines in particular, fuels having even higher pump octane ratings are needed.

The production of fuels of progressively higher pump octane ratings is progressively more difficult to achieve. In particular, fuels exhibiting a pump octane rating at or above 100 are highly desired and the most difficult to produce. This is particularly true for unleaded fuels.

Unfortunately, commercially available unleaded fuels that meet the CARB Phase 3 model and exhibit a pump octane rating of 93 or more tend to exhibit lower average torque output values and lower average power output values than may be desirable for high performance fuels.

A need exists for high octane unleaded fuel compositions that meet the CARB Phase 3 model and that have higher average torque outputs and/or higher average power outputs.

SUMMARY OF THE INVENTION

The present application provides balanced unleaded fuel compositions that exhibit a T50 (maximum) of 104.4° C. (220° F.) and a T90 (maximum) of 165.6° C. (330° F.), as required under the CARB Phase 3 model. The balanced unleaded fuel compositions exhibit higher average torque and higher average power output than commercially available fuels stated to meet the CARB Phase 3 model. The balanced unleaded fuel compositions exhibit a pump octane rating of greater than 93 and have an aromatic content of from 7 vol. % to 30 vol. %. In one embodiment, the balanced unleaded fuel compositions exhibit a pump octane rating of 99 or more. In one embodiment, the balanced unleaded fuel compositions exhibit a pump octane rating of 100 or more.

In one embodiment, the application provides balanced unleaded fuel compositions comprising:

- from about 2 vol. % to about 12 vol. % of a mixture of isoparaffins having 4 and 5 carbon atoms;
- from about 51 vol. % to about 73 vol. % alkylate having an initial boiling range of from about 34.4° C. (94° F.) to about 93.9° C. (201° F.) and a final boiling range of from about 109° C. (228.2° F.) to about 223° C. (433.4° F.), the alkylate comprising isoparaffins having from 4 to 13 carbon atoms, about 60 vol. % or more of the isoparaffins having from 7 to 8 carbon atoms;
- from about 5 vol. % to about 15 vol. % of one or more alkanol having from about 2 to 4 carbon atoms; and
- from about 7 vol. % to about 30 vol. % of an aromatic component comprising a quantity of one or more alkylated benzene having from 7 to 12 carbon atoms and an amount of a C9 aromatic component having a boiling range of from 161.7° C. (323° F.) to about 178° C. (352° F.), the C9 aromatic component comprising aromatic compounds having from about 8 to 11 carbon atoms, about 50 vol. % or more of the aromatic compounds have 9 carbon atoms;
- wherein the balanced unleaded fuel composition exhibits a pump octane rating of 100 or more, a T50 (maximum) of 104.4° C. (220° F.), and a T90 (maximum) of 165.6° C. (330° F.).

In one embodiment, the application provides balanced unleaded fuel compositions comprising:

- from about 2 vol. % to about 12 vol. % of a mixture of isoparaffins having from 4 to 5 carbon atoms;
- from about 51 vol. % to about 73 vol. % alkylate having an initial boiling range of from about 34.4° C. (94° F.) to about 93.9° C. (201° F.) and a final boiling range of from about 109° C. (228.2° F.) to about 223° C. (433.4° F.), the alkylate comprising isoparaffins having from 4 to 13 carbon atoms, about 60 vol. % or more of the isoparaffins having from 7 to 8 carbon atoms;
- from about 5 vol. % to about 15 vol. % of one or more alkanol having from about 2 to 4 carbon atoms;
- from about 7 vol. % to about 13 vol. % of one or more alkylated benzene having from 7 to 12 carbon atoms; and
- from about 8 to about 14 vol. % of a C9 aromatic component having a boiling range of from 161.7° C. (323° F.) to about 178° C. (352° F.), the C9 aromatic component comprising aromatic compounds having from about 8 to 11 carbon atoms, about 50 vol. % or more of the aromatic compounds having 9 carbon atoms;
- wherein the balanced unleaded fuel composition exhibits a pump octane rating of 100 or more, a T50 (maximum) of 104.4° C. (220° F.), and a T90 (maximum) of 165.6° C. (330° F.).

In another embodiment, the application provides balanced unleaded fuel compositions comprising:

- from about 2 vol. % to about 4 vol. % isobutane;
- from about 3 vol. % to about 7 vol. % isopentane;
- from about 49 vol. % to about 63 vol. % alkylate having an initial boiling range of from about 34.4° C. (94° F.) to about 93.9° C. (201° F.) and a final boiling range of from about 109.4° C. (228.4° F.) and 184.8° C. (364.7° F.), the alkylate comprising isoparaffins having from 4 to 13 carbon atoms, about 70 vol. % or more of the isoparaffins having from 7 to 8 carbon atoms;
- from about 7 vol. % to about 10 vol. % of one or more alkanol having from about 2 to 4 carbon atoms;
- from about 8 vol. % to about 12 vol. % of one or more alkylated benzene having from 7 to 12 carbon atoms; and
- from about 9 to about 15 vol. % of a C9 aromatic component having a boiling range of from 161.7° C. (323° F.) to about 178° C. (352° F.), the C9 aromatic component comprising aromatic compounds having from about 8 to 11 carbon atoms, about 50 vol. % or more of the aromatic compounds having 9 carbon atoms;

wherein the balanced unleaded fuel composition exhibits a pump octane rating of 99 or more, a T50 (maximum) of 104.4° C. (220° F.), and a T90 (maximum) of 165.6° C. (330° F.).

In one embodiment, the application provides balanced unleaded fuel compositions comprising the following, based on the total volume of the balanced unleaded fuel composition:

about 2.5 vol. % isobutane;

about 5 vol. % isopentane;

about 60.5 vol. % alkylate having an initial boiling range of from about 34.4° C. (94° F.) to about 93.9° C. (201° F.) and a final boiling range of from about 109.4° C. (228.4° F.) and 184° C. (364.7° F.), the alkylate comprising isoparaffins having from 4 to 13 carbon atoms, about 90 vol. % or more of the isoparaffins having from 7 to 8 carbon atoms;

about 10 vol. % ethanol;

about 10 vol. % toluene; and about 12 vol. % of a C9 aromatic component having a boiling range of from 161.7° C. (323° F.) to about 178° C. (352° F.), the C9 aromatic component comprising aromatic compounds having from about 8 to 11 carbon atoms, about 80 vol. % or more of the aromatic compounds having 9 carbon atoms;

wherein the balanced unleaded fuel composition exhibiting a pump octane rating of 100 or more, a T50 (maximum) of 104.4° C. (220° F.), and a T90 (maximum) of 165.6° C. (330° F.).

DETAILED DESCRIPTION OF THE INVENTION

Most commercially available fuels stated to meet the CARB Phase 3 model have a relatively low aromatic content of around 12 vol. % or less. Increasing the aromatic content of a high performance fuel, such as a racing fuel, could be expected to generate higher torque and higher power output values.

Unfortunately, it is difficult to balance an unleaded fuel composition to achieve all of the following:

(a) a pump octane rating of greater than 93, preferably 100 or more;

(b) a T50 (maximum) of 104.4° C. (220° F.) and a T90 (maximum) of 165.6° C. (330° F.), as required under the CARB Phase 3 model; and (c) an average torque value and/or average power output value that is higher than commercially available unleaded fuels that meet the CARB Phase 3 model (as shown in the Experimental Examples below).

The present application provides "balanced unleaded fuel compositions" that achieve all of (a)-(c).

Increased Average Torque Output Value

The average torque output value produced burning an unleaded fuel composition is important for vehicle acceleration. Average torque output values are even more important in high performance applications, such as racing applications. Specifically, the use of a fuel with a high average torque output value would assist the driver of a high performance vehicle in coming out of a turn or going down the back stretch of a race track. The average torque output value becomes particularly important at high speeds, such as those encountered in racing applications.

In various embodiments, the balanced unleaded fuel compositions exhibit an average torque output value that is the following amount higher than commercially available unleaded fuels stated to meet the CARB Phase 3 model: 1.08 N*m (0.8 pounds-force foot, or Lb*ft) or more; 1.22 N*m (0.9 Lb*ft) or more; 1.25 N*m (0.92 Lb*ft) or more; 1.27 N*m (0.94 Lb*ft) or more; 1.30 N*m (0.96 Lb*ft) or more; 1.33 N*m (0.98 Lb*ft) or more; 1.35 N*m (1 Lb*ft) or more; 1.49 N*m (1.1 Lb*ft) or more; and/or, 1.63 N*m (1.2 Lb*ft) or less.

In various embodiments, the balanced unleaded fuel compositions exhibit an average torque output value, compared to commercially available unleaded fuels stated to meet the CARB Phase 3 model, that is: 1.63 N*m (1.2 Lb*ft) or less higher; 1.25 N*m (0.92 Lb*ft) higher; or, 1.59 N*m (1.17 Lb*ft) higher.

In one embodiment, the balanced unleaded fuel compositions exhibit an average torque output value of greater than 545.29 N*m (402.19 Lb*ft). In various embodiments, average torque output value exhibited is: 545.3 N*m (402.20 Lb*ft) or higher; 545.45 N*m (402.3 Lb*ft) or higher; 545.58 N*m (402.40 Lb*ft) or higher; 545.72 N*m (402.50 Lb*ft) or higher; 545.85 N*m (402.60 Lb*ft) or higher; 545.99 N*m (402.70 Lb*ft) or higher; 546.12 N*m (402.80 Lb*ft) or higher; 546.26 N*m (402.90 Lb*ft) or higher; 546.4 N*m (403 Lb*ft) or higher; or, 546.53 N*m (403.10 Lb*ft) or higher.

Increased Average Power Output

In one embodiment, the balanced unleaded fuel compositions produce a higher average power output value than commercially available unleaded fuels stated to meet CARB Phase 3 requirements.

In various embodiments, the balanced unleaded fuel compositions exhibit an average power output value, compared to commercially available unleaded fuels stated to meet the CARB Phase 3 model, that is: 0.7 Brake Specific Horsepower (BHP) or more higher; 0.75 BHP or more higher; 0.76 BHP or more higher; 0.8 BHP or more higher; or, 0.85 BHP or more higher.

In one embodiment, the balanced unleaded fuel compositions exhibit a average power output value that is 0.76 BHP higher than commercially available unleaded fuels stated to meet the CARB Phase 3 model. In one embodiment, the balanced unleaded fuel compositions exhibit an average power output value that is 0.9 BHP higher than commercially available unleaded fuels stated to meet the CARB Phase 3 model.

In one embodiment, balanced unleaded fuel compositions exhibit an average power output value of greater than 351.65 BHP. In various embodiments, the average power output value exhibited is: 351.7 BHP or more; 351.8 BHP or more; 351.9 BHP or more; 352 BHP or more; 352.1 BHP or more; 352.2 BHP or more; 352.3 BHP or more; or, 352.4 BHP or more.

Pump Octane Rating

The pump octane rating of a fuel composition generally is calculated as the sum of the Research Octane Number (RON) and the Motor Octane Number (MON) divided by 2, i.e., (R+M)/2. Unless otherwise indicated, the Research Octane Number (RON) is determined according to method ASTM D-2699-04a (2004) and the Motor Octane Number (MON) is determined according to method ASTM D-2700-04a (2004), both incorporated by reference.

It is advantageous for the balanced unleaded fuel compositions to exhibit a pump octane rating sufficiently high to prevent the engine from knocking. In various embodiments, the balanced unleaded fuel compositions exhibit a pump octane rating of: greater than 93; 94 or more; 95 or more; 96 or more; 97 or more; 98 or more; 99 or more; 100 or more.

In one embodiment, the balanced unleaded fuel compositions exhibit such pump octane ratings free of any other ingredient or combination of ingredients that increases the pump octane rating of the balanced unleaded fuel composition by more than 1.0 unit.

Brake Specific Fuel Consumption

Brake Specific Fuel Consumption (BSFC) is the rate of fuel consumption divided by the power output of the engine, and is a measure of the fuel efficiency of an engine. In one embodiment, the balanced unleaded fuel compositions exhibit the same or higher BSFC than commercially available unleaded fuels that meet CARB Phase 3 model.

In various embodiments, the balanced unleaded fuel compositions exhibit a BSFC that is: greater than 48 g/(kW/h); 48.5 g/(kW/h) or more; or, 49 g/(kW/h) or more. In one embodiment, the balanced unleaded fuel composition exhibits a BSFC of 49.

Initial and Final Boiling Ranges

The initial boiling range and the final boiling range of the balanced unleaded fuel composition will vary with the precise content of the balanced unleaded fuel composition. In general, the balanced unleaded fuel compositions exhibit a higher initial boiling point and/or a higher final boiling point than commercially available high octane unleaded fuels that meet the CARB Phase 3 model.

Initial Boiling Range

In one embodiment, commercially available high octane fuels stated to meet the CARB Phase 3 model exhibit a minimum initial boiling point of about 40.6° C. (105° F.). In various embodiments, the balanced unleaded fuel compositions exhibit an initial boiling range of from about 34.4° C. (94° F.) to about 93.9° C. (201° F.); about 38° C. (100° F.) to about 85° C. (185° F.); from about 40.6° C. (105° F.) to about 51.7° C. (125° F.); from about 43.3° C. (110° F.) to about 48.9° C. (120° F.). from about 46.1° C. (115° F.) to about 48.9° C. (120° F.). In one embodiment, the initial boiling point (IBP) is about 47.7° C. (117.9° F.).

Final Boiling Range

In various embodiments, commercially available high octane unleaded fuels stated to meet the CARB Phase 3 model exhibit a final boiling range of from about 107.2° C. (225° F.) to 121.1° C. (250° F.).

In various embodiments, the balanced unleaded fuel compositions exhibit a final boiling range of from about 109° C. (228.2° F.) to about 233° C. (433.4° F.). In various embodiments, the balanced unleaded fuel compositions exhibit a final boiling range of: from 179.4° C. (355° F.)-193.3° C. (380° F.); from about 182.2° C. (360° F.) to about 190.6° C. (375° F.); from about 185° C. (365° F.) to about ° C. 187.8° C. (370° F.). In one embodiment, the final boiling point (FBP) is about 185.8° C. (366.4° F.).

The balanced unleaded fuel composition analyzed in Experimental Example I exhibited an initial boiling point (IBP) of 47.7° C. (117.9° F.) and a final boiling point (FBP) of 185.8° C. (366.4° F.).

In Experimental Example I, the IBP and FBP were measured for Comparative Fuel 1 (CF-1), a racing fuel stated to meet the CARB Phase 3 model and to exhibit a pump octane rating of 99.5. CF-1 exhibited an IBP of about 43° C. (109.4° F.) and exhibited a FBP of about 110.7° C. (231.3° F.).

API Gravity

The American Petroleum Institute (API) gravity exhibited by the balanced unleaded fuel composition will vary with the precise content of the balanced unleaded fuel composition. In general, the API gravity exhibited by the balanced unleaded fuel composition is lower than commercially available high octane unleaded fuels stated to meet the CARB Phase 3 model.

In various embodiments, the balanced unleaded fuel compositions exhibit the following API gravity, as measured according to ASTM D4052(IP365)-96 (1996): from about 55-65° API; from about 57-63° API; or, from about 59-61° API. In the embodiment of Experimental Example I, the balanced unleaded fuel composition exhibited an API gravity of 59.9° API, as measured according to ASTM D4052 (IP365)-96 (1996).

In contrast, the API gravity exhibited by commercially available high octane unleaded fuel compositions stated to meet the CARB Phase 3 model typically is: 63° API or more; more than 63° API; 64° API or more; more than 64° API; 65° API or more; or, more than 65° API. In Experimental Example 1, the API exhibited by CF-1 was 65.7° API.

Specific Gravity

The specific gravity exhibited by the balanced unleaded fuel compositions also will vary with the precise content of the balanced unleaded fuel composition. In general, the specific gravity exhibited by the balanced unleaded fuel compositions will be lower than commercially available high octane fuels stated to meet the CARB Phase 3 model. In various embodiments, the balanced unleaded fuel compositions exhibit a specific gravity of 0.7 or more; 0.71 or more; or 0.72 or more. In one embodiment, the specific gravity is about 0.73 or more. In one embodiment, the specific gravity is more than 0.73. In the balanced unleaded fuel compositions tested in Experimental Example I, the specific gravity was 0.7393.

In contrast, commercially available high octane unleaded fuel compositions stated to meet the CARB Phase 3 model typically exhibit a specific gravity of: less than 0.73; less than 72.5; or less than 0.72.

In Experimental Example I, the specific gravity exhibited by CF-1 was 0.7175.

Reid Vapor Pressure

The Reid Vapor Pressure (RVP) exhibited by the balanced unleaded fuel composition also will vary with the precise content of the fuel composition. In general, the RVP exhibited by the balanced unleaded fuel compositions will be higher than commercially available high octane fuels stated to meet the CARB Phase 3 model.

In various embodiments, the balanced unleaded fuel composition exhibits the following RVP, as measured using ASTM D323: more than 6.62 psi (44.13 kPa); 6.7 kPa (49.64 kPa) or more; 6.8 psi (46.88 kPa) or more; or, more than 6.8 psi (46.88 kPa). The experimental blend of Experimental Example I exhibited a RVP of 6.83 psi (47.09 kPa), as measured using ASTM D323.

In contrast, commercially available high octane unleaded fuel compositions stated to meet the CARB Phase 3 model generally exhibit a RVP in the range of from about 6.4 psi (44.13 psi) to about 7.2 psi (79.64), as measured using ASTM D323. In Experimental Example 1, CF-1 exhibited a RVP of 6.62 kPa, as measured using STM D323.

Smooth, Even Burn

In one embodiment, the balanced unleaded fuel composition exhibits a relatively smooth, even burn.

In one embodiment, the balanced unleaded fuel composition exhibits a T50 (maximum) of 104.4° C. (220° F.), as required under the CARB Phase 3 model. In one embodiment, the T50 (maximum) of the balanced unleaded fuel composition is from about 47.7° C. (117.9° F.) to about 102.2° C. (216° F.).

In one embodiment, the balanced unleaded fuel composition exhibits a T90 (maximum) of 165.6° C. (330° F.), as required under the CARB Phase 3 model. In one embodiment, the T90 (maximum) of the balanced unleaded fuel composition is about 141.9° C. (287.5° F.).

The Components

In various embodiments, the balanced unleaded fuel compositions comprise: from 51 vol. % to about 73 vol. % alkylate; from about 2 vol. % to about 12 vol. % isoparaffins; from about 5 to about 15 vol. % alkanol, and from about 7 to about 30 vol. % of an aromatic component.

Alkylate

In one embodiment, the balanced unleaded fuel composition comprises from about 51 vol. % to about 73 vol. % alkylate. In one embodiment, the alkylate is effective to stabilize the distillation curve of the balanced unleaded fuel composition along its length. In one embodiment, the alkylate assists the balanced unleaded fuel composition burning evenly in the engine.

The term "alkylate" typically refers to branched-chain paraffin. The branched-chain paraffin typically is derived from the reaction of isoparaffin with olefin. Alkylation is described, for example, in J. Gary, et al. *Petroleum Refining, Technology and Economics* (2d Ed. 1984) Chapter 10, pp. 159-183, and in *Kirk Othmer. Concise Encyclopedia of Chemical Technology* ($4^{th}$ Ed. 1999) Vol. 1, p. 75-76. Both of the cited portions of the foregoing references are hereby incorporated by reference.

Various grades of branched chain paraffins and mixtures are commercially available. The grade typically is identified by the range of the number of carbon atoms per molecule, the average molecular weight of the molecules, and/or the boiling point range of the alkylate. As used herein, the word "alkylate" refers to hydrocarbon compositions used for fuel applications comprising 90 volume % or more isoparaffins, as measured according to ASTM D5134-98 (2003), incorporated herein by reference.

In one embodiment, the alkylate comprises isoparaffins having from 4 to 13 carbon atoms. In various embodiments, the alkylate comprises isoparaffins having the following ranges of carbon atoms: from 4 to 12 carbon atoms; from 6 to 13 carbon atoms; and, from 7 to 8 carbon atoms. In one embodiment, the alkylate comprises isoparaffins consisting essentially of isoparaffins having from 7 to 8 carbon atoms.

In one embodiment, about 60 vol. % or more of the isoparaffins have from 7 to 8 carbon atoms. In various embodiments, the following vol. % of the isoparaffins have from about 7 to 8 carbon atoms: about 70 vol. % or more; about 80 vol. % or more; about 90 vol. % or more; about 95 vol. % or more; about 99 vol. % or more. In one embodiment, less than 8 vol. % of the isoparaffins have 10 carbon atoms or less.

In one embodiment, the alkylate meets one or more of the following parameters, as measured according to ASTM D5134-98 (2003): comprises less than 2.2 volume % paraffins; comprises less than 1 volume % olefins; comprises less than 5 volume % naphthenes; and/or, comprises less than 3 volume % aromatics.

In one embodiment, the alkylate has an initial boiling point of from about 34.4° C. (94° F.) to about 93.9° C. (201° F.) and a final boiling point of from about 109° C. (228.2° F.) to about 223° C. (433.4° F.).

In various embodiments, the alkylate has an initial boiling point of about 40° C. (104° F.) or more; about 50° C. (122° F.) or more; about 60° C. (140° F.) or more; about 70° C. (158° F.) or more; about 80° C. (176° F.) or more; or, about 90° C. (194° F.) or less.

In various embodiments, the alkylate has an final boiling point of about 115° C. (239° F.) or more; about 125° C. (258° F.) or more; about 135° C. (275° F.) or more; about 145° C. (293° F.) or more; about 155° C. (311° F.) or more; about 165° C. (329° F.) or more; about 175° C. (347° F.) or more; about 185° C. (365° F.) or more; about 195° C. (383° F.) or more; or, about 200° C. (392° F.) or less.

In one embodiment, the alkylate has an initial boiling point of from about 93.4° C. (200.1° F.) to about 93.9° C. (201° F.) and a final boiling point of from about 109.4° C. (228.4° F.) and 110.72° C. (231.3° F.).

In one embodiment, the alkylate meets one or more of the following parameters, as measured according to ASTM D5134-98 (2003): comprises less than 2.2 volume % paraffins; comprises less than 0.5 volume % olefins; comprises less than 3 volume % naphthenes; and, comprises less than 3 volume % aromatics.

In one embodiment, the alkylate meets one or more of the following parameters, as measured according to ASTM D5134-98 (2003): comprises less than 1 volume % paraffins; comprises less than 0.3 volume % olefins; comprises less than 3 volume % naphthenes; and, comprises less than 3 volume % aromatics.

Suitable alkylates can be obtained from a variety of sources, including, but not limited to: Shell Chemical Company USA; Chevron Phillips Chemical Company; Shell Deer Park Refining Company; Motiva Enterprises, LLC; Total Petrochemicals USA; and, KMI Chemicals, Inc., and various refineries. In one embodiment, the alkylate is SOLTROL 10, available from Chevron Phillips Chemical Company.

In various embodiments, the balanced unleaded fuel composition comprises the following vol. % alkylate: about 51 vol. % or more; about 50 vol. % or more; about 49 vol. % or more; about 48 vol. % or more; about 47 vol. % or more; about 46 vol. % or more; about 45 vol. % or more; about 44 vol. % or more; or, about 43 vol. % or more.

In various embodiments, the balanced unleaded fuel composition comprises the following vol. % alkyate: about 73 vol. % or less; about 72 vol. % or less; about 71 vol. % or less; about 70 vol. % or less; about 69 vol. % or less; about 68 vol. % or less; about 67 vol. % or less; about 66 vol. % or less; about 65 vol. % or less; about 64 vol. % or less; about 63 vol. % or less; about 62 vol. % or less; about 61 vol. % or less; about 60 vol. % or less; about 59 vol. % or less; about 58 vol. % or less.

In one embodiment, the balanced unleaded fuel composition comprises about 49 to about 63 vol. % alkylate. In one embodiment, the balanced unleaded fuel composition comprises 60.5 vol. % alkylate.

Alkanol

In one embodiment, the balanced unleaded fuel composition comprises from about 5 vol. % to about 15 vol. % alkanol. In one embodiment the alkanol has from 2 to 4 carbon atoms. In one embodiment, the alkanol is ethanol.

In one embodiment, the balanced unleaded fuel composition comprises a sufficient amount of alkanol to boost the pump octane rating of the balanced unleaded fuel composition to the desired level. In such embodiments, the balanced unleaded fuel composition comprises: about 5 vol. % or more alkanol; about 6 vol. % or more alkanol; about 7 vol. % or more alkanol; about 8 vol. % or more alkanol; or, about 9 vol. % or more alkanol.

In various embodiments, the balanced unleaded fuel composition comprises: about 15 vol. % or less alkanol; about 14 vol. % or less alkanol; about 13 vol. % or less alkanol; about 12 vol. % or less alkanol; or, about 11 vol. % or less alkanol.

In various embodiments, the balanced unleaded fuel composition comprises the following amount of alkanol, based on the total volume of the balanced unleaded fuel composition: from about 5 vol. % to about 15 vol. %; from about 7 vol. % to about 10 vol. %; or, about 10 vol. % alkanol. In one embodiment, the balanced unleaded fuel composition comprises 10 vol. % alkanol.

Aromatic Component

In various embodiments, the balanced unleaded fuel composition comprises the following amount of an aromatic component, based on total volume of the balanced unleaded fuel composition: from greater than 7 vol. % to about 30 vol. %; from 12 vol. % to about 30 vol. %; from 15 vol. % to about 30 vol. %; and, from about 17 vol. % to about 27 vol. %.

In various embodiments, the balanced unleaded fuel composition comprises the following vol. % or more of the aromatic component, on the same basis: about 10 vol. %; about 11 vol. %; about 12 vol. %; about 13 vol. %; about 15 vol. %; about 18 vol. %; about 20 vol. %.

In one embodiment, the balanced unleaded fuel composition comprises the following vol. % or less of the aromatic component, on the same basis: about 30 vol. %; about 29 vol. %; about 28 vol. %; about 27 vol. %; about 26 vol. %; about 25 vol. %; about 24 vol. %; about 23 vol. %; about 22 vol. %; about 21 vol. %; about 20 vol. %; about 19 vol. %; about 18 vol. %; about 17 vol. %; about 16 vol. %; about 15 vol. %; about 14 vol. %; about 13 vol. %.

In one embodiment, the balanced unleaded fuel composition comprises about from about 20 to about 21 vol. % of the aromatic component. In one embodiment, the balanced unleaded fuel composition comprises from 20 vol. % to 21 vol. % of the aromatic component.

In one embodiment, the aromatic component comprises a combination of two or more aromatic compounds having from 7 to 12 carbon atoms. In one embodiment, the aromatic component comprises a combination of alkylated benzenes having from 7 to 12 carbon atoms and a C9 aromatic component having from about 8 to about 11 carbon atoms. In one embodiment, the aromatic component comprises a combination of alkylated benzenes having from 7 to 9 carbon atoms and a C9 aromatic component having from about 8 to about 10 carbon atoms.

Alkylated Benzenes

In one embodiment, the balanced unleaded fuel composition comprises an aromatic component comprising one or more alkylated benzenes. Suitable alkylated benzenes are selected from the group consisting of mono-, di-, and tri-alkylated benzenes having the following general structure:

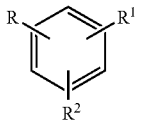

wherein R, $R^1$, and $R^2$ are selected from the group consisting of hydrogen and alkyl groups having from 1_ to 4 carbon atoms, provided that at least one of R, $R^1$, and $R^2$ is an alkyl group. In one embodiment, R, $R^1$, and $R^2$ are selected from the group consisting of hydrogen and alkyl groups having from 1 to 2 carbon atoms. In one embodiment, R, $R^1$, and $R^2$ are selected from the group consisting of hydrogen and methyl groups.

In one embodiment, the one or more alkylated benzenes are mono-alkylated benzenes. In one embodiment, the mono-alkylated benzene comprises an alkyl group having from 1 to 2 carbon atoms.

In another embodiment, the alkylated benzene is a di-alkylated benzene. In one embodiment, the di-alkylated benzene is a m-alkylated benzene. In one embodiment, the alkylated benzene is m-xylene.

In another embodiment, the alkylated benzene is a tri-alkylated benzene. In one embodiment, one or more of R, $R^1$, and $R^2$ are methyl groups. In one embodiment, the tri-alkylated benzene is 1,3,5-trimethylbenzene.

In one embodiment, the balanced unleaded fuel composition comprises the following vol. % alkylated benzenes, based on the total volume of the balanced unleaded fuel composition: about 7 vol. % or more; about 7.5 vol. % or more; about 8 vol. % or more; about 8.5 vol. % or more; about 9 vol. % or more; or, about 9.5 vol. % or more.

In one embodiment, the balanced unleaded fuel composition comprises the following vol. % alkylated benzenes, on the same basis: about 13 vol. % or less; about 12.5 vol. % or less; about 12 vol. % or less; about 11.5 vol. % or less; about 11 vol. % or less.

In one embodiment, the alkylated benzene is toluene.

In one embodiment, the balanced unleaded fuel composition comprises about 10 vol. % alkylated benzenes. In one embodiment, the balanced unleaded fuel composition comprises 10 vol. % alkylated benzenes.

In one embodiment, the balanced unleaded fuel composition comprises about 10 vol. % toluene. In one embodiment, the balanced unleaded fuel composition comprises 10 vol. % toluene.

C9 Aromatic Component

In one embodiment, the balanced unleaded fuel composition also comprises a "C9 aromatic component." The C9 aromatic component primarily comprises aromatic compounds, a majority of the aromatic compounds having 9 carbon atoms.

In one embodiment, the C9 aromatic component has the following general structure:

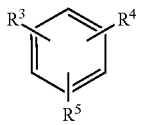

wherein $R^3$, $R^4$, and $R^5$ are selected from the group consisting of hydrogen and alkyl groups having from 1 to 3 carbon atoms, provided that at least one of $R^3$, $R^4$, and $R^5$ is an alkyl group and the total number of carbon atoms is from 8 to 11. In one embodiment, $R^3$, $R^4$, and $R^5$ are selected from the group consisting of hydrogen and alkyl groups having from 1 to 2 carbon atoms. In one embodiment, $R^3$, $R^4$, and $R^5$ are selected from the group consisting of hydrogen and methyl groups. In one embodiment, one or more of $R^3$, $R^4$, and $R^5$ are methyl groups.

In one embodiment, the C9 aromatic component comprises: one or more mono-alkylated benzenes; one or more di-alkylated benzenes; one or more a tri-alkylated benzenes; or a combination thereof.

In one embodiment, a majority of the aromatic compounds in the C9 aromatic component have a total number of carbon atoms of from 9 to 10. In one embodiment, based on the volume of the C9 aromatic carbon compound, the vol. % of the aromatic carbon compounds having 9 carbon atoms is: 50 vol. % or more; 60 vol. % or more; 70 vol. % or more; or, 80 vol. % or more; 83 vol. % or more.

In one embodiment, on the same basis, the vol. % of the aromatic compounds having 10 carbon atoms is 50 vol. % or less; 40 vol. % or less; 30 vol. % or less; 20 vol. % or less, or, 15 vol. % or less. In one embodiment, on the same basis, the vol. % of C9 aromatic hydrocarbons is from 83 to 84 vol. % and the vol. % of C10 aromatic hydrocarbons is from 14 to 15 vol. %

In one embodiment, the C9 aromatic component is a refinery distillation cut having a boiling range of from 160° C. (320° F.) to about 182° C. (359.6° F.). In one embodiment, the C9 aromatic component is a refinery distillation cut having a boiling range of from 161.7° C. (323° F.) to about 178° C. (352° F.).

Suitable commercially available products meeting the foregoing profile are Aromatic 100 streams or products, available from a variety of sources. In one embodiment, the C9 aromatic component is SHELLSOL A 100, commercially available from Shell Chemical Company USA.

In various embodiments, the balanced unleaded fuel composition comprises the following vol. % of the C9 aromatic component, based on the total volume of the balanced unleaded fuel composition: about 8 vol. % or more; about 9 vol. % or more; about 10 vol. % or more; about 11 vol. % or more; or, about 12 vol. % or more.

In various embodiments, the balanced unleaded fuel composition comprises the following vol. % of the C9 aromatic component, on the same basis: about 17 vol. % or less; about 16 vol. % or less; about 15 vol. % or less; about 14 vol. % or less; or, about 13 vol. % or less.

In various embodiments, the balanced unleaded fuel composition comprises the following vol. % of the C9 aromatic component, on the same basis: from about 8 vol. % to about 15 vol. %; from about 9 vol. % to about 15 vol. %; from about 8 vol. % to about 14 vol. %; from about 10 vol. % to about 13 vol. %; or, from about 11 vol. % to about 13 vol. %.

In one embodiment, the balanced unleaded fuel composition comprises from about 11 vol. % to about 12 vol. % of the C9 aromatic component. In one embodiment, the balanced unleaded fuel composition comprises from 11 vol. % to 12 vol. % of the C9 aromatic component.

In one embodiment, the balanced unleaded fuel composition comprises about 12 vol. % of the C9 aromatic component. In one embodiment, the balanced unleaded fuel composition comprises 12 vol. % of the C9 aromatic component.

In various embodiments, the balanced unleaded fuel composition comprises a blend of from about 7 vol. % to about 13 vol. % of one or more alkylated benzenes and from about 8 vol. % to about 14 vol. % of the C9 aromatic component. In various embodiments, the balanced unleaded fuel composition comprises a blend of the following: from about 8 vol. % to about 12 vol. % of one or more alkylated benzenes and from about 9 vol. % to about 15 vol. % of the C9 aromatic component; or, about 10 vol. % of one or more alkylated benzenes and about 11 vol. % of the C9 aromatic component. In one embodiment, the balanced unleaded fuel composition comprises 12 vol. % or less of SHELLSOL A 100™, resulting in a concentration of 11 vol. % of the C9 aromatic components (active ingredient) in the balanced unleaded fuel composition.

In one embodiment, the aromatic component volatilizes evenly and produces a relatively smooth distillation curve, averaged over a RPM range of from about 3100 to about 6000, thereby increasing the average power output value of the engine burning the balanced unleaded fuel composition.

Isoparaffins

In one embodiment, the balanced unleaded fuel compositions comprise one or more isoparaffins. In one embodiment, the balanced unleaded fuel compositions comprise a mixture of isoparaffins. In one embodiment, the mixture of isoparaffins is a mixture of isobutane and isopentane.

In one embodiment, the balanced unleaded fuel compositions comprise from about 2 vol. % to about 12 vol. % of the mixture of isoparaffins.

Isobutane

In one embodiment, the balanced unleaded fuel compositions comprise from about 2 vol. % to about 4 vol. % isobutane.

In various embodiments, the balanced unleaded fuel compositions comprise: 4 vol. % or less isobutane; 3.5 vol. % or less isobutane; 3 vol. % or less isobutane; or 2.5 vol. % or less isobutane. In one embodiment, the balanced unleaded fuel compositions comprise 2 vol. % or more isobutane; 2.1 vol. % or more isobutane; 2.2 vol. % or more isobutane; 2.3 vol. % or more isobutane; 2.3 vol. % or more isobutane; 2.4 vol. % or more isobutane.

In one embodiment, the balanced unleaded fuel compositions comprises about 2.5 vol. % isobutane. In one embodiment, the balanced unleaded fuel composition comprises 2.5 vol. % isobutane.

Isopentane

In one embodiment, the balanced unleaded fuel compositions comprise from about 3 vol. % to about 7 vol. % isopentane.

In various embodiments, the balanced unleaded fuel compositions comprise the following vol. % isopentane, based on the total volume of the balanced unleaded fuel composition: about 7 vol. % or less; about 6.5 vol. % or less; about 6 vol. % or less; about 5.5 vol. % or less; about 5.0 vol. % or less isopentane; about 4.5 vol. % or less isopentane; about 4.0 vol. % or less isopentane; or, about 3.5 vol. % or less isopentane. In one embodiment, the balanced unleaded fuel compositions comprise about 3 vol. % or more isopentane.

In one embodiment, the balanced unleaded fuel composition comprises about 5 vol. % isopentane. In one embodiment, the balanced unleaded fuel composition comprises 5 vol. % isopentane.

The isoparaffins are commercially available from a variety of sources and/or may be made by known processes. Examples of suitable preparations are described in F. L. Howard, et al. *J. Res. Nat. Bur. Standards Research Paper RP*1779, Vol. 38 (March 1947) pp. 365-395, incorporated herein by reference. The isoparaffins made by the above processes may be used as a blend or purified further.

If desired, the isoparaffins may be obtained by fractional distillation of refinery streams, e.g., straight run gasolines, or alkylation products. Other known methods of making the isoparaffins include, for example, reaction of alkyl metallic compounds (Grignard reagents) with carbonyl compounds, such as aldehydes, ketones, esters, or anhydrides, to form branched chain carbinols, which are dehydrated to the corresponding olefin and thereafter hydrogenated to the alkane.

Suitable commercial sources for isoparaffins meeting the foregoing specifications include, for example, Shell Chemical Company USA; Chevron Phillips Chemical Company; Lyondell Bassell; and, Citgo Petroleum Corporation. In one embodiment, the isoparaffins are SOLTROL 10™, commercially available form Chevron Phillips Chemical Company.

Specific Formulations

In specific embodiments, the application provides a balanced unleaded fuel composition comprising the following, based on the total volume of the balanced unleaded fuel composition: from about 2 vol. % to about 4 vol. % isobutane; from about from about 3 vol. % to about 7 vol. % isopentane; from about 49 vol. % to abut 63 vol. % alkylate; from about 7 to about 10 vol. % alkanol; from about 8 vol. % to about 12 volume % alkylated benzene; and, from about 9 vol. % to about 15 vol. % C9 aromatic component. In one embodiment, the balanced unleaded fuel composition exhibits: a pump octane rating of greater than 93; a T50 (maximum) of 104.4° C. (220° F.); and, a T90 (maximum) of 165.6° C. (330° F.). In one embodiment, the balanced unleaded fuel composition exhibits a pump octane rating of 99 or more. In one embodiment, the balanced unleaded fuel composition exhibits a pump octane rating of 100 or more.

In one embodiment, the application provides a balanced unleaded fuel composition comprising the following, based on the total volume of the balanced unleaded fuel composition: about 2.5 vol. % isobutane; about 4 vol. % isopentane; about 60.5 vol. % alkylate; about 10 vol. % ethanol; about 10 volume % of toluene and from about 11 vol. % to about 12 vol. % C9 aromatic component. In one embodiment, the balanced unleaded fuel composition exhibits: a pump octane rating of greater than 93; a T50 (maximum) of 104.4° C. (220° F.); and, a T90 (maximum) of 165.6° C. (330° F.). In one embodiment, the balanced unleaded fuel composition exhibits a pump octane rating of 99 or more. In one embodiment, the balanced unleaded fuel composition exhibits a pump octane rating of 100 or more.

Other Additives and/or Components

The balanced unleaded fuel composition optionally may comprise a variety of other components. Suitable components include, for example, fuel additives as listed in ASTM D-4814-04 (2004), incorporated herein by reference, or as specified by a regulatory body, e.g., CARB or the U.S. Environmental Protection Agency (EPA).

In one embodiment, the balanced unleaded fuel composition comprises corrosion inhibitor. Suitable corrosion inhibitors include, for example, carboxylic acids, esters, alkanolamides, amines, etc.

The balanced unleaded fuel composition also may comprise other additives or components. Examples of other components suitable for use in the balanced unleaded fuel composition include other paraffins, aromatic hydrocarbons, and alcohols. In jurisdictions where the CARB Phase 3 model does not apply, ethers and/or esters. Refinery streams that may be used in the balanced unleaded fuel composition include, for example, distillation products and reaction products from a refinery such as catalytic reformate, heavy catalytic cracked spirit, light catalytic cracked spirit, straight run gasoline, isomerate, light reformate, light hydrocrackate, and naphtha. Other gasoline components include olefins (in particular with one double bond per molecule). Examples include liquid alkene having from 5 to 10 carbon atoms. In one embodiment, the liquid alkene has from 6 to 8 carbon atoms. The liquid alkene may be linear or branched. Specific examples of suitable liquid alkenes include pentene, isopentene, hexene, isohexene, heptene, and mixtures thereof.

Examples of other paraffins that may be used in the balanced unleaded fuel include cyclic paraffins. In one embodiment, the balanced unleaded fuel composition comprises naphtha. In various embodiments, where the balanced unleaded fuel composition comprises naphtha, the balanced unleaded fuel composition comprises: less than 17.9 weight percent naphtha; less than 15 weight percent naphtha; less than 10 weight percent naphtha; less than 5 weight percent naphtha; less than 2 weight percent naphtha; or, less than 1 weight percent naphtha. In one embodiment, the balanced unleaded fuel composition does not comprise naphtha.

The balanced unleaded fuel composition also may contain lead replacement additives and/or other common additives which have no significant impact on pump octane rating, for example, dyes, deicing agents, agents for preventing exhaust valve seat wear, anti-oxidants, corrosion inhibitors, anti-static additives, detergents and the like.

The balanced unleaded fuel composition may not comprise any additive. The balanced unleaded fuel composition also may comprise one or more fuel additives. Where used, the balanced unleaded fuel composition typically comprises the following total amount of additives: about 1000 ppm or less; about 0.1 ppm or more; about 0.5 ppm or more; about 1 ppm or more; about 100 ppm or less; about 50 ppm or less; about 20 ppm or less.

In one embodiment, the balanced unleaded fuel composition comprises lead replacement additive. In one embodiment, the balanced unleaded fuel composition comprises antioxidant. In one embodiment, the balanced unleaded fuel composition comprises detergent additive. In one embodiment, the balanced unleaded fuel composition comprises a combination of lead replacement additive, antioxidant, and detergent additive.

Where used, the balanced unleaded fuel composition typically comprises, for example: about 20 mg/kg or more lead replacement additive; about 25 mg/kg or more lead replacement additive; about 30 mg/kg or more lead replacement additive; about 60 mg/kg or less lead replacement additive; about 55 mg/kg or less lead replacement additive; or, about 50 mg/kg or less lead replacement additive.

Where used, the balanced unleaded fuel composition typically comprises, for example: about 10 mg/kg or more antioxidant; about 15 mg/kg or more antioxidant; about 20 mg/kg or more antioxidant; about 50 mg/kg or less antioxidant; about 45 mg/kg or less antioxidant; or, about 40 mg/kg or less antioxidant.

Where used, the balanced unleaded fuel composition typically comprises, for example: about 0.01 g/liter (0.05 g/gallon or 3.8 liter) or more detergent additive; about 0.02 g/liter (0.08 g/gallon, or 3.8 liter) or more detergent additive; about 0.03 g/liter (0.1 g/gallon) or more detergent additive; about 1 g/liter (4 g/gallon) or less detergent additive; about 0.9 g/liter (3.5 g/gallon) or less detergent additive; or, about 0.8 g/liter (3 g/gallon) or less detergent additive. Suitable detergent additives include, for example, polyisobutylene amines, polyisobutylene Mannich reaction products, polyether amines, and combinations thereof.

In one embodiment, the balanced unleaded fuel composition comprises: about 40 mg/kg lead replacement additive; about 30 mg/kg antioxidant; and, from about 0.3 g/liter (1 g/gallon) to about 0.5 g/liter (2 g/gallon) detergent additive.

When not Required to Meet

CARB Phase 3 Model

Although the balanced unleaded fuel compositions meet the CARB Phase 3 model, it may be desirable to use the balanced unleaded fuel compositions in environments that are not required to meet the CARB Phase 3 model. In such embodiments, the balanced unleaded fuel composition may comprise other additives.

For example, in such environments, the pump octane rating of the balanced unleaded fuel composition may be boosted using one or more oxygenate octane boosters other than or in addition to alkanol. Suitable oxygenate octane boosters include, for example, alkyl ethers.

In one embodiment, the balanced unleaded fuel composition further comprises alkyl ether comprising an alkyl group having from 1 to 6 carbon atoms. In one embodiment, the alkyl group has from 3 to 6 carbon atoms. In one embodiment, the alkyl group is a branched chain alkyl group having from 3 to 6 carbon atoms. In one embodiment, the alkyl group is a tertiary alkyl group having from 4 to 6 carbon atoms. Suitable tertiary alkyl groups include, for example, tert-butyl groups and tert-amyl groups.

In one embodiment, the alkyl ether is dialkyl ether. In one embodiment, the alkyl ether is asymmetric dialkyl ether. In one embodiment, the dialkyl ether comprises a first tertiary alkyl group and a second alkyl group having from 1 to 6 carbon atoms. In one embodiment, the dialkyl ether comprises a first tertiary alkyl group and second alkyl group having from 1 to 3 carbon atoms. In one embodiment, the second alkyl group is a linear alkyl group. In one embodiment, the second alkyl group is selected from the group consisting of a methyl group and an ethyl group. Specific examples of suitable alkyl ethers include methyl tertiary butyl ether (MTBE), ethyl tertiary butyl ether, and methyl tertiary amyl ether.

Specific examples of suitable blends are given in the following examples, which are illustrative only and should not be construed as limiting the claims:

Comparative Example 1

U.S. Pat. No. 4,812,146 to Jessup relates to fuels for high performance engines and for racing engines in particular. Jessup describes "a fuel composition . . . containing at least four components selected from the group consisting of butane, isopentane, toluene, MTBE, and alkylate, with alkylate being one such component and toluene another, said fuel having an octane value of about 100 or more." Jessup, co. 1, ll. 34-39.

Unfortunately, MTBE (methyl tertiary butyl ether) is not permitted under the Carb Phase 3 model. MTBE raises concerns about air and drinking water quality, and has been banned from use in gasolines in California.

In Example 3, Table 5, Jessup describes a fuel that does not comprise MTBE. However, the fuel comprises 60 vol. % toluene. The use of such a large amount of aromatic is undesirable. As Jessup explains, "higher levels of aromatics in the fuel may cause problems with elastomer components and/or drivability." Jessup, col. 3, ll. 9-11.

Comparative Example 2

U.S. Pat. No. 6,353,143 to Fang, et al ("Fang") describes a fuel composition which may comprise base fuels including "isoparaffins, branched paraffins, aromatic hydrocarbons, and mixtures thereof . . . in the amount of 50% to about 100%." Fang, col. 1, ll. 37-41. Fang states that "[preferably, the octane number of the fuel compositions is greater than about 70, more preferably, the octane number of the fuel composition is greater than about 81." Fang, col. 2, ll. 1-3.

Fang reports the "octane number" of a number of commercially available branched paraffins in Table 2. Fang, col. 6, ll. 14-33. The highest of the reported "octane numbers" is 90.5 [(86.1+94.9)/2] for Isopar H, which is available from Exxon Chemical. Id., and Fang, col. 3, lines 36-47. The highest reported "octane number" in Fang's Examples is 90.5. Fang, Example 6, col. 7, ll. 44-50.

Experimental Examples

The experimental balanced unleaded fuel compositions used in the following experimental example had a pump octane rating of 99 or more and fell within the following compositional ranges:

| Composition Ranges | |
|---|---|
| Component | Vol. % |
| Isoparaffins | 2-12 |
| Alkylate (60 vol. % or more comprising isoparaffins having 7 to 8 carbon atoms) | 51-73 |
| Alkanol | 5-15 |
| Aromatic component (50 vol. % or more having 9 carbon atoms) | 7-30 |

More specifically, the experimental balanced unleaded fuel compositions fell within the following compositional ranges:

| Composition Ranges | |
|---|---|
| Component | Vol. % |
| Isoparaffins | 2-12 |
| Alkylate (60 vol. % or more comprising isoparaffins having 7 to 8 carbon atoms) | 51-73 |
| Alkanol | 5-15 |
| Alkylated benzene | 7-13 |
| C9 aromatic component | 8-14 |

Even more specifically, the experimental balanced unleaded fuel compositions fell within the following compositional ranges:

| Composition Ranges | |
|---|---|
| Component | Vol. % |
| Isobutane | 2-3 |
| Isopentane | 4-5 |
| Alkylate (90 vol. % or more comprising isoparaffins having 7 to 8 carbon atoms) | 60-62 |
| Ethanol | 10 |
| Toluene | 10 |
| C9 aromatic component | 12 |

The alkylates (SOLTROL 10™, A, B, and C) used in the experimental balanced unleaded fuel compositions had the composition given in the following Table. The numbers in the following Table represent the normalized volume %, based on the total volume of the composition, pursuant to the referenced ASTM test methods. The referenced ASTM methods are incorporated herein by reference:

| Method | | SOLTROL 10 ™ | | A* | B** | | C*** |
|---|---|---|---|---|---|---|---|
| | Test | | | | | | |
| ASTM D4052 (IP365)-96 (1996) (°API) | API Gravity | | | | | | 70.1 |
| | Sample | | | | | | |
| ASTM D6730-06 (2006)(Vol. %) | Paraffins | 0 | | 0.6 | 0.37 | | 2.18 |
| Vol. % | Iso-Paraffins | 99.94 | | 95.44 | 93.38 | | 92.62 |
| Vol. % | Olefins | 0 | | 0.12 | 0.14 | | 0.4 |
| Vol. % | Naphthenes | 0 | | 0.51 | 2.57 | | 1.27 |
| Vol. % | Aromatics | 0.06 | | 2.66 | 2.65 | | 2.71 |
| Vol. % | Unknown | 0 | | 0.67 | 0.89 | | 0.82 |
| Distillation 5 (ASTM D86-07) ° C.(° F.) | Initial Boiling Point | 1 200.1 | 2 201 | 128 | 1 110.6 | 2 112.3 | 94.9 |
| ° C.(° F.) | 5% Evaporated | 204.3 | 204.2 | 170 | 161.2 | 162.2 | 150 |
| ° C.(° F.) | 10% Evaporated | 294.5 | 204.4 | 184 | 183.3 | 183.8 | 165.7 |
| ° C.(° F.) | 20% Evaporated | 204.9 | 204.9 | 203 | 202.7 | 202.9 | 190.3 |
| ° C.(° F.) | 30% Evaporated | 20.3 | 205.3 | 214 | 214.3 | 214.1 | 207.1 |
| ° C.(° F.) | 40% Evaporated | 205.7 | 205.6 | 221 | 221.4 | 221.2 | 215.9 |
| ° C.(° F.) | 50% Evaporated | 206 | 206.1 | 227 | 227.2 | 226.7 | 220.6 |
| ° C.(° F.) | 60% Evaporated | 206.6 | 206.6 | 231 | 232.9 | 231.9 | 224.2 |
| ° C.(° F.) | 70% Evaporated | 207.3 | 207.3 | 239 | 239.9 | 237.8 | 227.5 |
| ° C.(° F.) | 80% Evaporated | 208.1 | 2008.3 | 254 | 251.9 | 250.7 | 234.5 |
| ° C.(° F.) | 90% Evaporated | 209.6 | 209.8 | 317 | 298.2 | 297.8 | 262.6 |
| ° C.(° F.) | 95% Evaporated | 211.3 | 211.6 | 375 | 358.1 | 359.5 | 293.3 |
| ° C.(° F.) | Final Boiling Point | 228.4 | 231.3 | 432 | 413.6 | 410.4 | 364.7 |
| Vol. % | % Recovered | 97.5 | 97.7 | 98 | 97.4 | 97.5 | 98.6 |
| Vol. % | % Residue | 0.9 | 1 | 1 | 1.1 | 1 | 1 |
| Vol. % | % Loss | 1.5 | 1.3 | 1 | 1.5 | 1.5 | 0.4 |
| Vol. % | E200 | NR | NR | NR | 18.4 | 18.1 | NR |
| Vol. % | E300 | NR | NR | NR | 90.1 | 90.2 | NR |

*Motiva alkylate.
**Total alkylate.
***KMI -Pasadena (Lyondell) alkylate.

The alkylate comprised greater than 97 vol. % isoparaffins.

The C9 aromatic component was SHELLSOL A 100™, for which the following properties were measured:

| Method | Test | SHELLSOL A 100 ™ |
|---|---|---|
| ASTM D6730-06 (2006)(Vol. %) | Paraffins | |
| Vol. % | Iso-Paraffins | |
| Vol. % | Olefins | |
| Vol. % | Naphthenes | |
| Vol. % | Aromatics | 99.94 |
| | C8 | 1.09 |
| | C9 | 83.85 |
| | C10 | 14.99 |
| | C11 | 0 |
| Vol. % | Unknown (C11) | 0.06 |
| Distillation 5 (ASTM D86-07) ° C.(° F.) | Initial Boiling Point | 323 |
| ° C.(° F.) | 5% Evaporated | 324.9 |
| ° C.(° F.) | 10% Evaporated | 325.1 |
| ° C.(° F.) | 20% Evaporated | 325.7 |
| ° C.(° F.) | 30% Evaporated | 326.4 |
| ° C.(° F.) | 40% Evaporated | 327 |
| ° C.(° F.) | 50% Evaporated | 327.7 |
| ° C.(° F.) | 60% Evaporated | 328.5 |
| ° C.(° F.) | 70% Evaporated | 329.5 |
| ° C.(° F.) | 80% Evaporated | 331.1 |
| ° C.(° F.) | 90% Evaporated | 334.1 |
| ° C.(° F.) | 95% Evaporated | 337.6 |
| ° C.(° F.) | Final Boiling Point | 351.7 |
| Vol. % | % Recovered | 99.8 |

-continued

| Method | Test | SHELLSOL A 100 ™ |
|---|---|---|
| Vol. % | % Residue | 0.1 |
| Vol. % | % Loss | 0.1 |

Experimental Example 1

The following experimental balanced unleaded fuel composition ("Experimental Blend") was prepared and tested for physical properties compared to Comparative Fuel-1 (CF-1).

The Experimental Blend had the following composition:

| | Experimental Blend Vol. % |
|---|---|
| Isobutane | 3 |
| Isopentane | 4 |
| C7/C8 Isoparaffins* | 54 |
| Alkylate | 7 |
| Toluene | 10 |
| C9 aromatic component** | 12 |
| Ethanol | 10 |
| Total | 100 |

*SOLTROL 10 ™, commercially available from Chevron Phillips Chemical Company.
**SHELLSOL Aromatic 100 ™ (US), commercially available from Shell Chemical Company The CF-1 had the following properties:

| | COMPETITOR A |
|---|---|
| Specific Gravity @ 15° C. | 0.7175 |
| API Gravity @ 60° F. | 65.7 |
| Distillation | ° F. |
| IBP | 109.4 |
| 5% | 139 |
| 10% | 144.8 |
| 20% | 152.1 |
| 30% | 159 |
| 40% | 189.2 |
| 50% | 208.7 |
| 60% | 210.3 |
| 70% | 210.6 |
| 80% | 210.9 |
| 90% | 211.6 |
| 95% | 212.8 |
| FBP | 231.3 |
| Recovery | 97.5 |
| Residue | 1 |
| Loss | 1.5 |
| E200 | 45.6 |
| E300 | 108.9 |
| Existent Gum | |
| Before (mg/100 ml) | 5.5 |
| After (mg/100 ml) | <0.5 |
| FIA | |
| Arom vol % | 11.1 |
| Olefins vol % | 0.4 |
| Sat vol % | 88.5 |
| RON | 104 |
| MON | 95 |
| R + M/2 | 99.5 |
| RVP | 6.62 |
| Sulfur (mg/kg) | <1 |

The properties of Experimental Blend and for CF-1 were evaluated as follows:

| | Experimental Blend | Competitor A |
|---|---|---|
| IBP {° C.(° F.)} | 47.7° C.(117.9° F.) | 43° C.(109.4° F.) |
| 5% | 62.2° C.(43.9° F.) | 59.4° C.(139° F.) |
| 10% | 66.1° C.(151° F.) | 62.7° C.(144.8° F.) |
| 20% | 69.8° C.(157.7° F.) | 66.7° C.(152.1° F.) |
| 30% | 76.2° C.(169.2° F.) | 70.6° C.(159° F.) |
| 40% | 98.9° C.(210° F.) | 87.3° C.(189.2° F.) |
| 50% | 102.2° C.(216° F.) | 98.2° C.(208.7° F.) |
| 60% | 104.3° C.(219.7° F.) | 99.1° C.(210.3° F.) |
| 70% | 107.6° C.(225.6° F.) | 99.2° C.(210.6° F.) |
| 80% | 114° C.(237.2° F.) | 99.4° C.(210.9° F.) |
| 90% | 141.9° C.(287.5° F.) | 99.8° C.(211.6° F.) |
| 95% | 164° C.(327.6° F.) | 100.4° C.(212.8° F.) |
| FBP | 185.8° C.(366.4° F.) | 110.7° C.(231.3° F.) |
| Rec (vol. %) | 97.1 | 97.5 |
| Res | 1 | 1 |
| Loss | 1.9 | 1.5 |
| E200 | 42.1 | 45.6 |
| E300 | 92.2 | 108.9 |
| API | 59.9 | 65.7 |
| Specific Gravity | 0.7393 | 0.7175 |
| RVP | 6.83 | 6.62 |
| Sulfur | <1 | <1 |
| Existent Gum | | |
| Unwashed (mg/100 ml) | 1 | 5.5 |
| Washed | <0.5 | |
| RON | 105 | 104 |
| MON | 94.5 | 95 |
| R + M/2 | 99.8 | 99.5 |

-continued

| | Experimental Blend | Competitor A |
|---|---|---|
| FIA | | |
| Aromatics | 21.1 | 11.1 |
| Olefins | 1.1 | 0.4 |
| Saturates | 77.8 | 88.5 |
| CARB Phase 3 Model | yes | yes |
| EPA | yes | yes |

The RON, MON, and pump octane rating [R+M)/2] were measured according to ASTM D-2699-04a (RON) and ASTM D-2700-04a (MON)(2004).

Experimental Example 2

The Experimental Blend described in Experimental Example 1 was compared to two leading unleaded racing fuels commercially available in the United States, designated Commercial Blend A and Commercial Blend B. Commercial Blend A and Commercial Blend B were analyzed and found to have the following properties:

| | Competitor A | Competitor B |
|---|---|---|
| Specific Gravity @ 15° C. | 0.7175 | 0.7475 |
| API Gravity @ 60° F. | 65.7 | 57.8 |
| Distillation | ° F. | ° F. |
| IBP | 109.4 | 110.4 |
| 5% | 139 | 141.1 |
| 10% | 144.8 | 146.9 |
| 20% | 152.1 | 155 |
| 30% | 159 | 167 |
| 40% | 189.2 | 204.8 |
| 50% | 208.7 | 213 |
| 60% | 210.3 | 214.4 |
| 70% | 210.6 | 215.2 |
| 80% | 210.9 | 216.2 |
| 90% | 211.6 | 218.4 |
| 95% | 212.8 | 221.4 |
| FBP | 231.3 | 239 |
| Recovery | 97.5 | 97.7 |
| Residue | 1 | 1 |
| Loss | 1.5 | 1.3 |
| E200 | 45.6 | 43.5 |
| E300 | 108.9 | 107.4 |
| Existent Gum | | |
| Before (mg/100 ml) | 5.5 | 13.5 |
| After (mg/100 ml) | <0.5 | 3 |
| FIA | | |
| Arom vol % | 11.1 | 28.2 |
| Olefins vol % | 0.4 | 0.8 |
| Sat vol % | 88.5 | 71 |
| RON | 104 | 105 |
| MON | 95 | 94.5 |
| R + M/2 | 99.5 | 99.8 |
| RVP | 6.62 | 6.43 |
| Sulfur (mg/kg) | <1 | <1 |

Commercial Blend A and Commercial Blend B were stated to meet the CARB Phase 3 model and to have a pump octane rating of greater than 93.

The average torque output value, the average power output value, and the average BSFC for the fuels were compared using a Chevy 350 cubic inch crate engine.

The following were the results:

| | Experimental Blend | Commercial Blend A | Commercial Blend B |
|---|---|---|---|
| Average BHP | 352.41 | 351.51 | 351.65 |
| Average Torque | 403.11 | 401.94 | 402.19 |
| Average BSFC | 0.49 | 0.49 | 0.48 |

As seen from the foregoing, the Experimental Blend exhibited a higher average torque output value and a higher average BHP (power output) value than either of the two commercially available blends. The Experimental Blend also generated an average BSFC that was either equal to or higher than the two competitor fuels.

Persons of ordinary skill in the art will recognize that many modifications may be made to the foregoing description. The embodiments described herein are meant to be illustrative only and should not be taken as limiting the invention, which will be defined in the claims.

What is claimed is:

1. A balanced unleaded fuel composition comprising:

from about 2 vol. % to about 12 vol. % of a mixture of isoparaffins having 4 and carbon atoms;

from about 51 vol. % to about 73 vol. % alkylate having an initial boiling range of from about 34.4° C. (94° F.) to about 93.9° C. (201° F.) and a final boiling range of from about 109° C. (228.2° F.) to about 223° C. (433.4° F.), the alkylate comprising isoparaffins having from 4 to 13 carbon atoms, about 60 vol. % or more of the isoparaffins having from 7 to 8 carbon atoms;

from about 5 vol. % to about 15 vol. % of one or more alkanol having from about 2 to 4 carbon atoms; and from about 7 vol. % to about 30 vol. % of an aromatic component comprising a quantity of one or more alkylated benzene having from 7 to 12 carbon atoms and an amount of a C9 aromatic component having a boiling range of from 161.7° C. (323° F.) to about 178° C. (352° F.), the C9 aromatic component comprising aromatic compounds having from about 8 to 11 carbon atoms, about 50 vol. % or more of the aromatic compounds having 9 carbon atoms;

wherein the balanced unleaded fuel composition exhibiting a pump octane rating of 100 or more, a T50 (maximum) of 104.4° C. (220° F.), and a T90 (maximum) of 165.6° C. (330° F.).

2. The balanced unleaded fuel composition of claim 1 exhibiting:

an average torque output value of greater than 545.29 N*m (402.19 Lbs*ft); and an average power output value of greater than 351.65 BHP.

3. The balanced unleaded fuel composition of claim 1 exhibiting:

an average torque output value of 546.39 N*m (403 Lbs*ft) or more; and an average power output value of 352 BHP or more.

4. The balanced unleaded fuel composition of claim 1 wherein the one or more alkylated benzene and the C9 aromatic component have the following general structure;

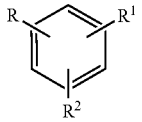

wherein:

in the one or more alkylated benzene, R, $R^1$, and $R^2$ are selected from the group consisting of hydrogen and alkyl groups having from 1 to 2 carbon atoms; and in the C9 aromatic component, R, $R^1$, and $R^2$ are selected from the group consisting of hydrogen and alkyl groups having from 1 to 3 carbon atoms.

5. The balanced unleaded fuel composition of claim 1 wherein:

about 60 vol. % or more of the aromatic compounds have 9 carbon atoms; and the alkylate comprises about 90 vol. % or more of the isoparaffins in having from 7 to 8 carbon atoms.

6. The balanced unleaded fuel composition of claim 1 wherein the alkylate comprises:

less than 2.2 volume % paraffins;

less than 1 volume % olefins;

less than 5 volume % naphthenes; and less than 3 volume % aromatics.

7. The balanced unleaded fuel composition of claim 1 wherein the alkylate comprises:

less than 1 volume % paraffins;

less than 0.3 volume % olefins;

less than 3 volume % naphthenes; and less than 3 volume % aromatics.

8. A balanced unleaded fuel composition comprising:

from about 2 vol. % to about 12 vol. % of a mixture of isoparaffins having from 4 to 5 carbon atoms;

from about 51 vol. % to about 73 vol. % alkylate having an initial boiling range of from about 34.4° C. (94° F.) to about 93.9° C. (201° F.) and a final boiling range of from about 109° C. (228.2° F.) to about 223° C. (433.4° F.), the alkylate comprising isoparaffins having from 4 to 13 carbon atoms, about 60 vol. % or more of the isoparaffins having from 7 to 8 carbon atoms;

from about 5 vol. % to about 15 vol. % of one or more alkanol having from about 2 to 4 carbon atoms;

from about 7 vol. % to about 13 vol. % of one or more alkylated benzene having from 7 to 12 carbon atoms; and from about 8 to about 14 vol. % of a C9 aromatic component having a boiling range of from 161.7° C. (323° F.) to about 178° C. (352° F.), the C9 aromatic component comprising aromatic compounds having from about 8 to 11 carbon atoms, about 50 vol. % or more of the aromatic compounds having 9 carbon atoms;

wherein the balanced unleaded fuel composition exhibiting a pump octane rating of 100 or more, a T50 (maximum) of 104.4° C. (220° F.), and a T90 (maximum) of 165.6° C. (330° F.).

9. The balanced unleaded fuel composition of claim 8 exhibiting:

an average torque output value of greater than 545.29 N*m (402.19 Lbs*ft); and an average power output value of greater than 351.65 BHP.

10. The balanced unleaded fuel composition of claim 8 exhibiting:

an average torque output value of 546.39 N*m (403 Lbs*ft) or more; and an average power output value of 352 BHP or more.

11. The balanced unleaded fuel composition of claim 8 wherein the one or more alkylated benzene and the C9 aromatic component have the following general structure;

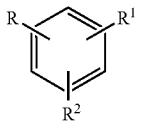

wherein:

in the one or more alkylated benzene, R, $R^1$, and $R^2$ are selected from the group consisting of hydrogen and alkyl groups having from 1 to 2 carbon atoms; and, in the C9 aromatic component, R, $R^1$, and $R^2$ are selected from the group consisting of hydrogen and alkyl groups having from 1 to 3 carbon atoms.

12. The balanced unleaded fuel composition of claim 8 wherein:

about 60 vol. % or more of the aromatic compounds have 9 carbon atoms;

and the alkylate comprises 90 vol. % or more of the isoparaffins in having from 7 to 8 carbon atoms.

13. The balanced unleaded fuel composition of claim 8 wherein the alkylate comprises:

less than 2.2 volume % paraffins;

less than 1 volume % olefins;

less than 5 volume % naphthenes; and less than 3 volume % aromatics.

14. The balanced unleaded fuel composition of claim 8 wherein the alkylate comprises:

less than 1 volume % paraffins;

less than 0.3 volume % olefins;

less than 3 volume % naphthenes; and less than 3 volume % aromatics.

15. A balanced unleaded fuel composition comprising:

from about 2 vol. % to about 4 vol. % isobutane;

from about 3 vol. % to about 7 vol. % isopentane;

from about 49 vol. % to about 63 vol. % alkylate having an initial boiling range of from about 34.4° C. (94° F.) to about 93.9° C. (201° F.) and a final boiling range of from about 109.4° C. (228.4° F.) and 184.8° C. (364.7° F.), the alkylate comprising isoparaffins having from 4 to 13 carbon atoms, about 70 vol. % or more of the isoparaffins having from 7 to 8 carbon atoms;

from about 7 vol. % to about 10 vol. % of one or more alkanol having from about 2 to 4 carbon atoms;

from about 8 vol. % to about 12 vol. % of one or more alkylated benzene having from 7 to 12 carbon atoms; and from about 9 to about 15 vol. % of a C9 aromatic component having a boiling range of from 161.7° C. (323° F.) to about 178° C. (352° F.), the C9 aromatic component comprising aromatic compounds having from about 8 to 11 carbon atoms, about 50 vol. % or more of the aromatic compounds having 9 carbon atoms;

wherein the unleaded fuel composition exhibits a pump octane rating of 99 or more, a T50 (maximum) of 104.4° C. (220° F.), and a T90 (maximum) of 165.6° C. (330° F.).

16. The balanced unleaded fuel composition of claim 15 exhibiting:

an average torque output value of greater than 545.29 N*m (402.19 Lbs*ft); and an average power output value of greater than 351.65 BHP.

17. The balanced unleaded fuel composition of claim 15 exhibiting:

an average torque output value of 546.39 N*m (403 Lbs*ft) or more; and an average power output value of 352 BHP or more.

18. The balanced unleaded fuel composition of claim 15 exhibiting a pump octane rating of 100 or more.

19. The balanced unleaded fuel composition of claim 16 exhibiting a pump octane rating of 100 or more.

20. The balanced unleaded fuel composition of claim 15 wherein the alkylate comprises:

less than 2.2 volume % paraffins;

less than 1 volume % olefins;

less than 5 volume % naphthenes; and less than 3 volume % aromatics.

21. The balanced unleaded fuel composition of claim 15 wherein the alkylate comprises:

less than 1 volume % paraffins;

less than 0.3 volume % olefins;

less than 3 volume % naphthenes; and less than 3 volume % aromatics.

22. A balanced unleaded fuel composition comprising:

about 2.5 vol. % isobutane;

about 5 vol. % isopentane;

about 60.5 vol. % alkylate having an initial boiling range of from about 34.4° C. (94° F.) to about 93.9° C. (201° F.) and a final boiling range of from about 109.4° C. (228.4° F.) and 184° C. (364.7° F.), the alkylate comprising isoparaffins having from 4 to 13 carbon atoms, about 90 vol. % or more of the isoparaffins having from 7 to 8 carbon atoms;

about 10 vol. % ethanol;

about 10 vol. % toluene; and about 12 vol. % of a C9 aromatic component having a boiling range of from 161.7° C. (323° F.) to about 178° C. (352° F.), the C9 aromatic component comprising aromatic compounds having from about 8 to 11 carbon atoms, about 80 vol. % or more of the aromatic compounds having 9 carbon atoms;

wherein the unleaded fuel composition exhibits a pump octane rating of 100 or more, a T50 (maximum) of 104.4° C. (220° F.), and a T90 (maximum) of 165.6° C. (330° F.).

23. The balanced unleaded fuel composition of claim 22 exhibiting:

an average torque output value of greater than 545.29 N*m (402.19 Lbs*ft); and an average power output value of greater than 351.65 BHP.

24. The balanced unleaded fuel composition of claim 22 exhibiting:

an average torque output value of 546.39 N*m (403 Lbs*ft) or more; and an average power output value of 352 BHP or more.

25. The balanced unleaded fuel composition of claim 22 wherein the alkylate comprises:

less than 2.2 volume % paraffins;

less than 1 volume % olefins;

less than 5 volume % naphthenes; and less than 3 volume % aromatics.

26. The balanced unleaded fuel composition of claim 22 wherein the alkylate comprises:

less than 1 volume % paraffins;

less than 0.3 volume % olefins;

less than 3 volume % naphthenes; and less than 3 volume % aromatics.

* * * * *